US012325992B2

(12) United States Patent
Rachwitz et al.

(10) Patent No.: US 12,325,992 B2
(45) Date of Patent: Jun. 10, 2025

(54) DRY-CONSTRUCTION STUD AND DRY-CONSTRUCTION WALL WITH A DRY-CONSTRUCTION STUD

(71) Applicant: Knauf Gips KG, Iphofen (DE)

(72) Inventors: Sylvia Rachwitz, Griesheim (DE); Michael Viebahn, Iphofen (DE)

(73) Assignee: Knauf Gips KG, Iphofen (DE)

( * ) Notice: Subject to any disclaimer, the term of this patent is extended or adjusted under 35 U.S.C. 154(b) by 152 days.

(21) Appl. No.: 17/926,587

(22) PCT Filed: May 22, 2020

(86) PCT No.: PCT/EP2020/000098
§ 371 (c)(1),
(2) Date: Nov. 19, 2022

(87) PCT Pub. No.: WO2021/233511
PCT Pub. Date: Nov. 25, 2021

(65) Prior Publication Data

US 2023/0183976 A1 Jun. 15, 2023

(51) Int. Cl.
*E04B 2/74* (2006.01)
*E04B 2/60* (2006.01)
(Continued)

(52) U.S. Cl.
CPC ..... *E04B 2/7412* (2013.01); *E04B 2/60* (2013.01); *E04B 2/789* (2013.01); *E04C 3/07* (2013.01);
(Continued)

(58) Field of Classification Search
CPC ..... E04C 3/07; E04C 3/32; E04C 2003/0443; E04C 2003/0473; E04B 2/60; E04B 2/789; E04B 2/7457; E04B 2/7412
See application file for complete search history.

(56) References Cited

U.S. PATENT DOCUMENTS 3,445,975 A * 5/1969 Nels ..... E04F 13/045 52/359
10,465,382 B2 * 11/2019 Rice ..... E04B 2/7457
(Continued)

FOREIGN PATENT DOCUMENTS

CA 2584677 A1 * 10/2008 ..... E04B 2/789
CA 2668945 A1 * 11/2010 ..... E04C 3/09
(Continued)

OTHER PUBLICATIONS

International Search Report and Written Opinion for International Patent Application No. PCT/EP2020/000098 dated Jan. 19, 2021; 12 pages.
(Continued)

*Primary Examiner* — Jessie T Fonseca
(74) *Attorney, Agent, or Firm* — Amburn Law PLLC; Dean W. Amburn

(57) ABSTRACT

The invention relates to a dry-connection stud having a web and a first and second flange connected to the web, wherein flange beads are provided in at least one of the flanges, wherein the flange beads each extend in the longitudinal direction of the stud over a flange bead length that is less than an overall length of the stud, wherein the flange beads are disposed at a center distance from each other. The invention further relates to a dry-construction wall with such a dry-construction stud.

6 Claims, 7 Drawing Sheets

(51) Int. Cl.

| | |
|---|---|
| ***E04B 2/78*** | (2006.01) |
| ***E04C 3/07*** | (2006.01) |
| ***E04C 3/32*** | (2006.01) |
| *E04C 3/04* | (2006.01) |

(52) U.S. Cl.
CPC ..... *E04C 3/32* (2013.01); *E04B 2/7457* (2013.01); *E04C 2003/0443* (2013.01); *E04C 2003/0473* (2013.01)

(56) References Cited

U.S. PATENT DOCUMENTS

| | | | | |
|---|---|---|---|---|
| 2005/0126104 | A1* | 6/2005 | Erickson | E04B 2/82 52/633 |
| 2006/0185315 | A1 | 8/2006 | Walker | |
| 2007/0011971 | A1* | 1/2007 | Sitkiewicz | E04B 2/767 52/481.1 |
| 2009/0249743 | A1* | 10/2009 | Bodnar | E04C 3/09 52/846 |
| 2010/0281821 | A1* | 11/2010 | Frobosilo | E04C 3/09 52/846 |
| 2013/0017407 | A1 | 1/2013 | Strickland et al. | |
| 2018/0148925 | A1* | 5/2018 | Rice | E04B 2/7457 |

FOREIGN PATENT DOCUMENTS

| | | | | | |
|---|---|---|---|---|---|
| CA | 2702746 | A1 | * | 11/2010 | E04C 3/09 |
| CA | 2944376 | A1 | * | 5/2017 | B21D 5/00 |
| CA | 2950255 | A1 | * | 5/2018 | |
| CN | 201318008 | Y | * | 9/2009 | |
| CN | 103122669 | A | * | 5/2013 | E04B 9/127 |
| CN | 203230088 | U | * | 10/2013 | |
| DE | 29808344 | U1 | | 8/1998 | |
| EP | 0638758 | A2 | * | 2/1995 | |
| EP | 1375769 | A2 | | 1/2004 | |
| EP | 2796630 | A1 | * | 10/2014 | E04B 1/24 |
| FR | 2996868 | A1 | * | 4/2014 | E04B 2/789 |
| JP | S60-194006 | A | | 10/1985 | |
| JP | H06299675 | A | | 10/1994 | |
| WO | WO-2006105825 | A1 | * | 10/2006 | E04B 2/7412 |
| WO | WO-2007082366 | A1 | * | 7/2007 | B21D 19/00 |
| WO | WO-2007134436 | A1 | * | 11/2007 | E04B 2/789 |
| WO | WO-2016034906 | A1 | * | 3/2016 | B21D 13/04 |

OTHER PUBLICATIONS

Notice of refusal in parallel Japanese Patent Application 2022-570323 dated Feb. 9, 2024 and English translation thereof.

* cited by examiner

DRY-CONSTRUCTION STUD AND DRY-CONSTRUCTION WALL WITH A DRY-CONSTRUCTION STUD

CROSS-REFERENCE TO RELATED APPLICATIONS

The subject patent application is a U.S. National Stage Patent Application which claims priority to and all the benefits of International Patent Application No. PCT/EP2020/000098, filed on May 22, 2020, the disclosure of which is hereby incorporated by reference.

BACKGROUND

The invention relates to a dry-construction stud having a web and a first and a second flange connected to the web, wherein flange beads are provided in at least one of the flanges, wherein the flange beads each extend in the longitudinal direction of the stud over a flange bead length that is less than an overall length of the stud, wherein the flange beads are disposed at a center distance from each other. The invention further relates to a dry-construction wall with such a dry-construction stud.

Dry construction refers to the manufacture of construction elements, in particular dry-construction walls, through the assembly of industrially manufactured semi-finished products. Typically, dry-construction walls are created by erecting a support structure of stud elements, to which panels are attached. In order to achieve a smooth surface, the joints are usually provided with a filler. For the support structure, dry-construction studs made of sheet metal are often used. These are easy to handle due to their light weight. In addition, they allow the construction of stable dry-construction walls with good sound insulation values. Dry-construction walls can be walls in buildings, which are created after the construction of a shell. Dry-construction walls created in dry-construction can also be used for exterior walls and load-bearing building components, if suitable materials are used.

A known dry-construction stud designed as a C-stud is described in EP 1 866 492 A1. In the case of the known stud, the flange beads point outwards. In addition, two narrow beads are provided in the web, each of which is arranged in an edge portion.

Further C-studs for dry construction and the dry-construction walls produced using them are described in EP 1 375 769 A2 and EP 2 015 879 A1.

SUMMARY

The invention has the object of specifying a dry-construction stud, which enables the sound insulating properties of a drywall to be improved in a simple manner.

The object is solved with the characteristics of claim 1. Accordingly, in the case of the dry-construction stud mentioned above, it is provided that the web has a first web section, which forms an edge portion of the web and merges into a bent first flange connecting section that connects the first flange to the web, and that the web has a second web section, which forms a further edge portion of the web and merges into a bent second flange connecting section that connects the second web section to the second flange, wherein the web has a web bead which is disposed between the first web section and the second web section. The claimed design makes it possible to significantly improve the acoustic properties of a dry-construction wall made with the dry-construction studs. In particular, the sound reduction index of a dry-construction wall that serves as a partition wall between two rooms is improved. An improvement is also achieved, if the drywall forms a facing shell in front of a wall. This can be achieved without the need for costly additional measures, simply through to the optimized shape of the dry-construction stud. This makes it possible to achieve the advantageous acoustic properties without having to modify the structure of the dry-construction wall. Rather, the dry-construction stud can be used in the same way as the previously known dry-construction studs. The dry-construction stud is also characterized by the fact that it is easy and safe to work with. Finally, the dry-construction stud is stable. It is assumed that the claimed arrangement of the flange beads along with the claimed arrangement of the first and second web sections as well as the web bead are responsible for the improvement of the acoustic properties. In this context, it also plays a role how the described design increases the stiffness in different sections of the dry-construction stud in certain directions, so that, on the one hand, the stud is stable enough to easily absorb the forces occurring in a drywall. On the other hand, the stiffness is deliberately reduced in certain sections or certain directions, which counteracts the transmission of sound in a dry-construction wall.

In the following, advantageous embodiments of the invention are described. The additional characteristics contribute in particular to further improving the acoustic properties of the dry-construction stud. In addition, they are also relevant for simple and safe handling of dry-construction studs and for achieving high stability at low cost.

According to the invention, it is preferred for the web bead to be arranged in the center of the web. Preferably, the web has only one web bead.

An advantageous embodiment of the invention provides for the first and second web section to have the same width.

According to the invention, it is preferred that the first and second web sections have a width between 8 mm and 15 mm (preferably between 9 mm and 11 mm). Furthermore, it is preferred for the web bead to have a width greater than the width of each of the first or second web sections.

An advantageous embodiment of the invention provides that the web bead protrudes in a direction towards the inside of the stud. The inside refers to the space between the first and second flanges of the stud.

An advantageous embodiment of the invention provides that the first and second web sections are arranged in a first plane and a central region of the web bead in a second plane. Preferably, the aforementioned central region can be formed straight.

An advantageous embodiment of the invention provides for the stud to be a metal stud. The metal stud can be made of steel, preferably galvanized steel. The metal stud can preferably be manufactured by forming a flat metal sheet to a metal profile. Accordingly, the metal stud comprises a profiled metal body, but may contain other materials as well. Especially, the metal stud may contain coatings and/or additional elements.

An advantageous embodiment of the invention provides that the web bead has a web bead height which is between 1 and 5 times the material thickness of the metal stud. Preferably, the web bead height is between 2 times and 4 times the material thickness of the metal stud. The web bead height can be measured against the inside of the first and second web sections.

An advantageous embodiment of the invention provides that the web bead has a central region as well as a first transition region to the first web section and a second transition region to the second web section, wherein the first and second transition regions each have an obliquely arranged section, which is arranged at an angle of between 30° and 75° to the central region. The obliquely arranged section preferably has a straight cross-sectional surface.

An advantageous embodiment of the invention provides that the first and second transition regions each have a first radius and a second radius, with the obliquely arranged section arranged between the first and second radius.

An advantageous embodiment of the invention provides that the web bead extends continuously in the longitudinal direction of the stud over its entire length.

An advantageous embodiment of the invention provides that the bent first and second flange connecting sections each have a bending radius between 1 mm and 3 mm. The bending radius can be determined on the inside of the respective bent flange connecting section.

An advantageous embodiment of the invention provides that the flange beads are projecting in a direction towards the inside of the stud. Thus, the flange beads protrude in a direction towards the inside of the dry-construction stud. More preferably, all flange beads are projecting in a direction towards the inside of the stud.

An advantageous embodiment of the invention provides that all flange beads of one flange are arranged along a single straight line. Preferably, said single straight line is oriented parallel to the longitudinal direction of the stud.

Alternatively, the flange beads of one flange can be arranged along two, three or more lines, which are preferably parallel to each other. Those two, three or more straight lines can be oriented parallel to the longitudinal direction of the stud.

An advantageous embodiment of the invention provides that the flange beads are arranged in a central area of the flanges. The central area can be a section of the flange extending parallel to the longitudinal direction of the stud and having the same distance to a proximal and a distal end of the flange. Preferably, the flange beads are arranged in the middle of the flanges.

An advantageous embodiment of the invention provides that the flange beads have a flange bead height which is between 0.5 and 2 times (preferably between 0.75 and 1.5 times) the material thickness of the stud. The flange bead height can be measured against the inside of the respective flange.

An advantageous embodiment of the invention provides that the center distances of neighboring flange beads of a flange are between 100 mm and 250 mm.

According to the invention, the preferred flange bead length is between 40 mm and 70 mm. Preferably, all flange beads are formed in this way.

According to a preferred embodiment, the spacings between neighboring flange beads of one flange are between 30 mm and 210 mm. A spacing of between 100 mm and 150 mm is preferred. Further, it is preferred that the spacing between neighboring flange beads of one flange is uniform.

According to an advantageous embodiment of the invention, the flange bead lengths of at least 50% (preferably at least 70%, 80% or 90%) of the flange beads are the same.

An advantageous embodiment of the invention provides that the flange beads are semicircular beads or triangular beads.

An advantageous embodiment of the invention is that the flange beads have a bead width of between 2 mm and 4 mm.

An advantageous embodiment of the invention is that the flange beads have a flange bead height that is less than the web bead height.

An advantageous embodiment of the invention provides that the stud has a knurling in the area of the web and/or in the area of the first flanges and/or the area of the second flanges. Preferably, at least 40% (more preferably at least 60% or at least 80%) of the surface of the sheet material is knurled. The knurling comprises a large number of local plastic deformations. This, together with the other characteristics, contributes to a further improvement of the acoustic properties and good workability.

An advantageous embodiment of the invention provides that the width of the web is between 30 mm and 300 mm, and preferably between 48 mm and 200 mm.

An advantageous embodiment of the invention provides that the width of the flanges is between 30 mm and 60 mm, preferably between 47 mm and 49 mm.

An advantageous embodiment of the invention provides that the material thickness of the stud is between 0.4 mm and 1 mm, preferably between 0.5 mm and 0.8 mm.

An advantageous embodiment of the invention provides that the first flange has a smaller flange width than the second flange, so that the dry-construction stud can be connected to an identical further dry-construction stud to form a rectangular stud, the first flange of the dry-construction stud lying against the inside of the second flange of the further dry-construction stud.

An advantageous embodiment of the invention provides that the first and second flanges are disposed at an (outwardly widening) opening angle of between 1° and 6° (preferably between 3° and 4°) with respect to one another. This allows the angle between the first flange and the web to be in particular between 90.5° and 93° (preferably between 91.5° and 92°). This refers to the dry-construction stud prior to its assembly during the erection of a drywall. Due to the forces occurring during assembly, the first and second flanges can be deformed elastically or elastically and plastically. This can also further improve the acoustic properties.

An advantageous embodiment of the invention provides that the stud is a C-stud. It can show a C-shaped cross-section in a direction perpendicular to a longitudinal direction of the stud. In the case of the C-stud, the free end sections of the first and second flanges can be bent inwards.

The invention also refers to a dry-construction wall comprising at least one dry-construction stud of the type described and a paneling attached thereto. The paneling can include dry-construction boards in particular, wherein gypsum plasterboards, gypsum boards and fiber-cement boards are particularly preferred.

Further goals, characteristics, advantages and application possibilities of this invention result from the following description of embodiments based on the drawings. All described and/or depicted characteristics, individually or in any meaningful combination, form the object of the invention, also independently of the summary in individual claims or their back references. The figures as well as the corresponding description contain exemplary and non-restrictive information of possible embodiments of the invention.

DETAILED DESCRIPTION

Figure 1:
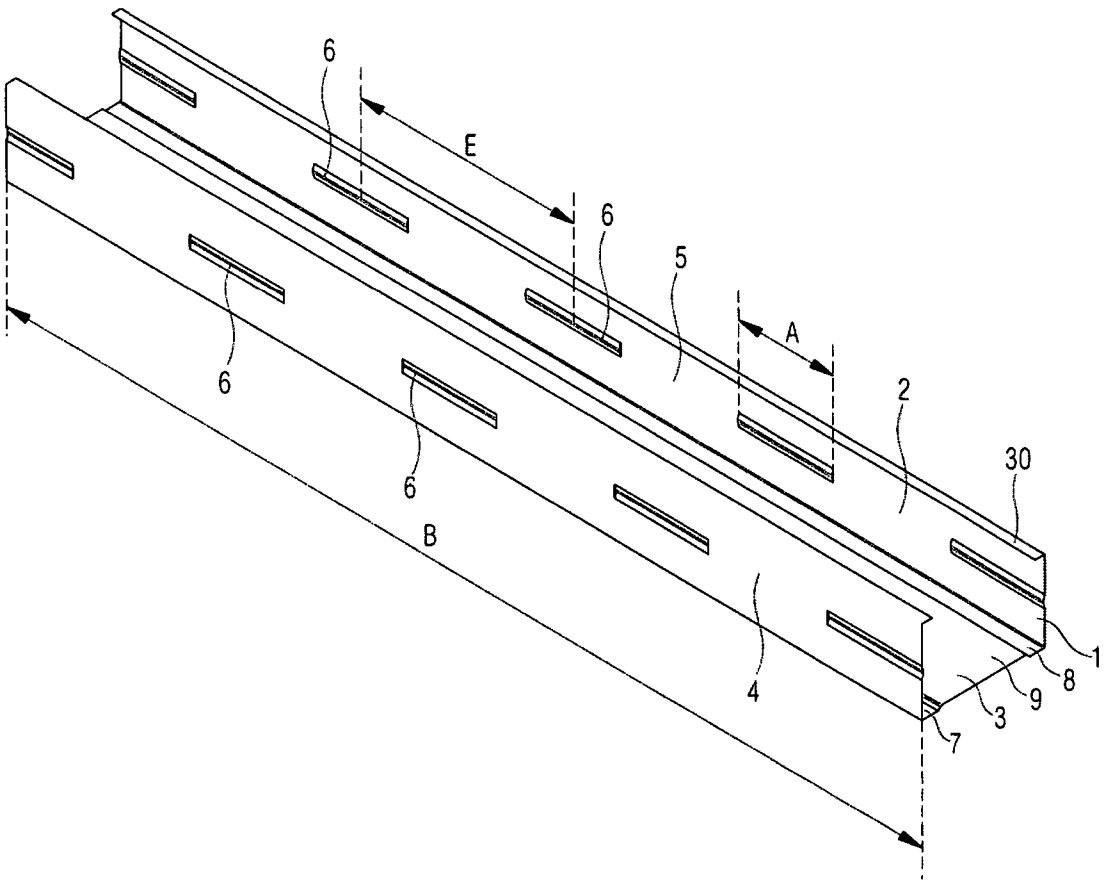
FIG. 1 is a perspective representation of a dry-construction stud according to the invention.
Figure 2:
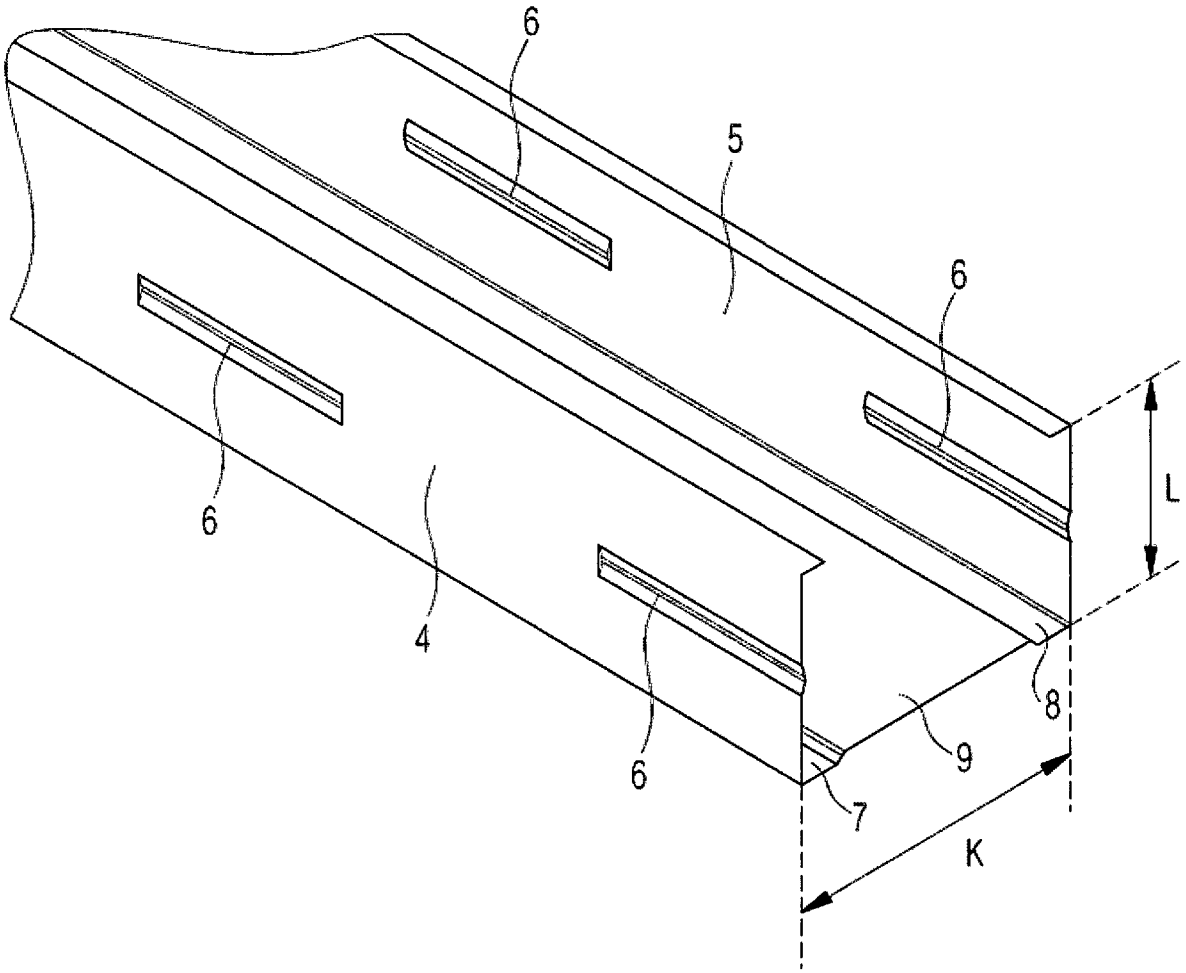
FIG. 2 is an enlarged representation of a section of the dry-construction stud from FIG. 1.
Figure 3:
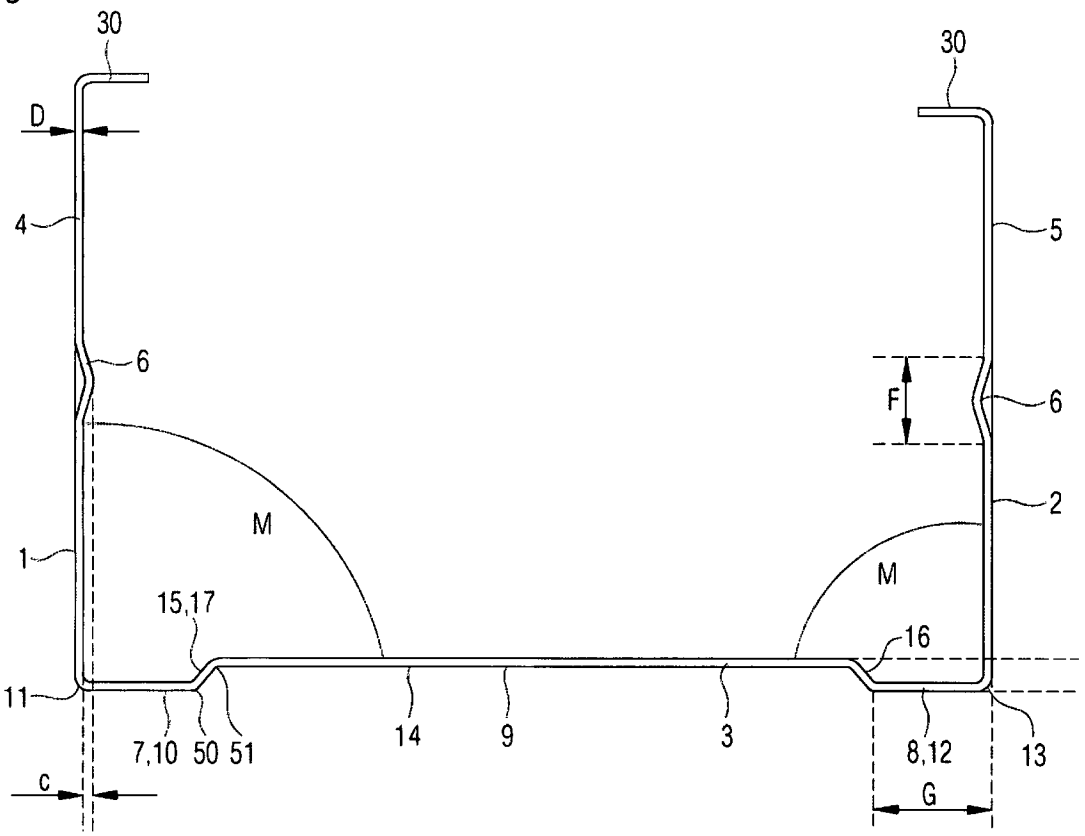
FIG. 3 is a cross-section through the dry-construction stud from FIG. 1.
Figure 4A:
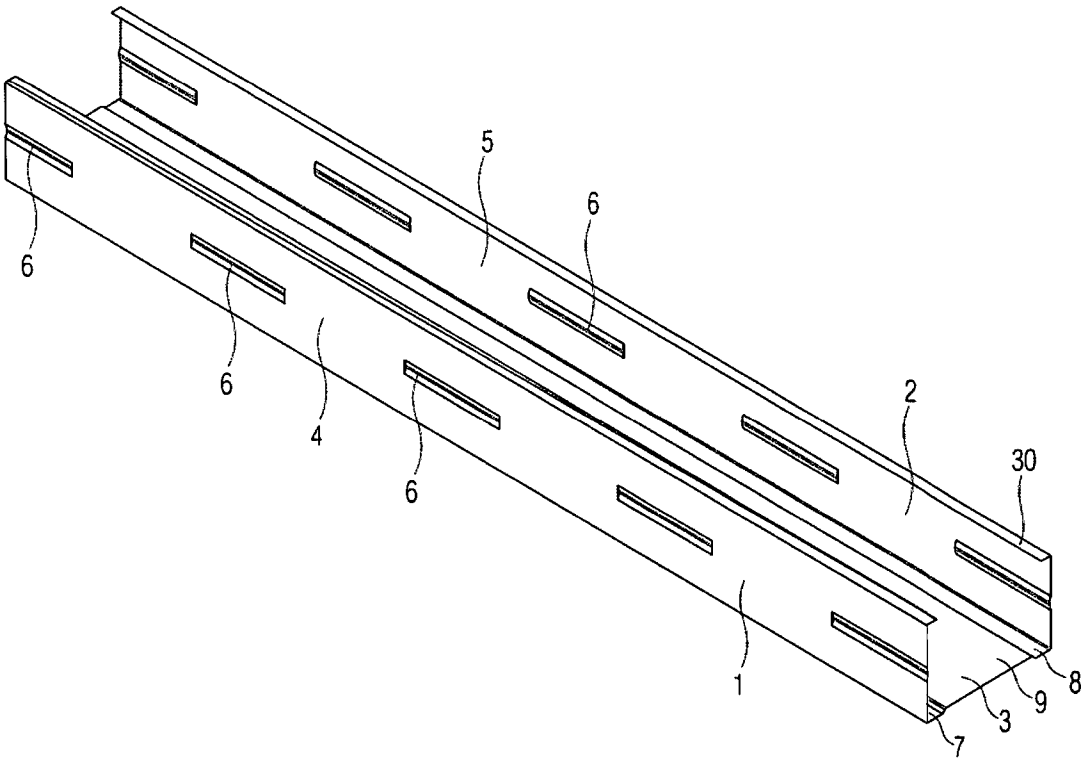
FIG. 4*a* is a further dry-construction stud according to the invention.
Figure 4B:
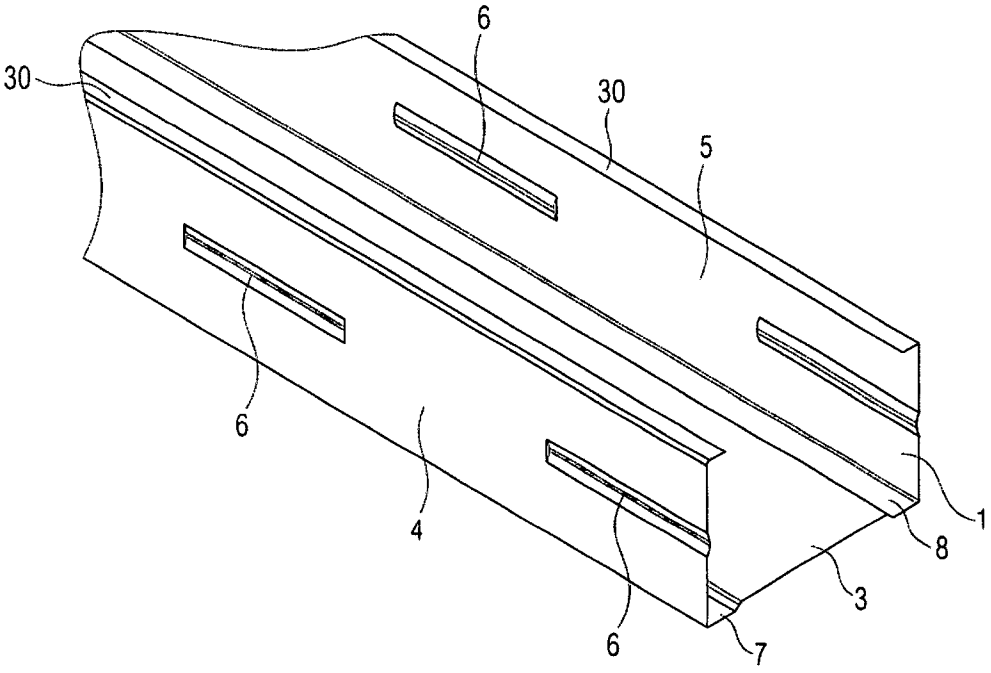
FIG. 4*b* is an enlarged representation of a section of the dry-construction stud from FIG. 4*a;*

FIGS. 1 to 3 show a first embodiment of a dry-construction stud that is not provided with a knurling. FIGS. 4*a* and 4*b* show an identical dry-construction stud provided additionally with a knurling. Therefore, in the following, where there are similarities, the embodiments are described jointly.

FIGS. 1 to 4*b* each show a dry-construction stud 1 which is a metal stud. The metal stud can be obtained by forming a sheet metal. The dry-construction stud 1 has a web 3 and a first and second flange 4, 5. The first and second flanges 4, 5 are arranged on the web 3. The first and second flanges 4, 5 as well as the web 3 are made of continuous metal sheet. During manufacture, the originally flat metal sheet is bent into the shape shown in FIGS. 1 to 4*b*.

The dry-construction stud 1 has several flange beads 6 in each of the first and second flanges 4, 5. The flange beads are aligned in such a way that they protrude in one direction towards the inside of the stud. The inside of the stud is formed by the space between the first and second flange 4, 5.

The flange beads 6 are each arranged in a central region of the first and second flanges 4, 5.

As shown, the flange beads 6 each extend in the longitudinal direction of the stud 1 over a bead length A, which is less than the total length B of the stud 1. The oblong flange beads 6 of one flange 4, 5 are all arranged along a single straight line. The first and second flanges 4, 5 have no further beads in addition to the flange beads 6.

The flange beads have a flange bead height C, which is between 0.5 and 2 times the material thickness D of the metal stud.

FIG. 1 further shows that spacings are formed between the flange beads 6, with the center distance E being between 100 mm and 250 mm. The bead length A of the flange beads is between 40 mm and 70 mm.

As shown in FIG. 3, the flange beads 6 can be formed as semicircular or triangular beads. They have a bead width F between 2 mm and 4 mm.

FIGS. 1 to 4*b* further show that the web 3 has a first web section 7 and a second web section 8, between which the web bead 9 is arranged. The first web section 7 forms an edge portion 10 of the web 3 and merges into a bent first flange connecting section 11, which connects the first flange 4 to the web 3. The second web section 8 forms a further edge portion 12 of the web 3 and merges into a bent second flange connecting section 13, which connects the second web section 8 to the second flange 5.

The web bead 9 extends in the longitudinal direction of the stud 1 throughout its entire length B.

As shown, the web bead 9 is arranged centrally in the web 3. In the exemplary embodiment shown, the first and second web sections 7, 8 each have a width G between 8 mm and 15 mm.

The web bead 9 is oriented towards the inside of the dry-construction stud 1. The first and second web sections 7, 8 are in one plane, while the central region of the web bead 9 is arranged in a second plane offset from the first plane.

The web bead 9 has a web bead height H, which is between 1 and 5 times the material thickness D of the metal stud.

The web bead 9 has a center region 14 as well as a first transition region 15 to the first web section 7 and a second transition region 16 to the second web section 8. The first and the second transition region 15, 16 each have an obliquely arranged section 17, which is arranged at an angle of between 30° and 75° to the center region 14.

FIG. 3 further shows that the first and second transition region 15, 16 each have a first and a second radius 50, 51, with the obliquely arranged section 17 being arranged between the first and the second radius 50, 51.

The dry-construction stud 1 shown is formed as a C-stud. The free end sections 30 of the first and second flanges 4, 5 are bent inwards over the entire length of the stud 1.

The width K of the web 3 can in particular be between 50 mm and 300 mm. The width L of the flanges 4, 5 can in particular be between 30 mm and 60 mm. The material thickness D of the metal stud can in particular be between 0.4 mm and 1 mm.

FIG. 3 also shows that the first and second flanges 4, 5 are not aligned parallel, but can have an (outwardly widening) opening angle between 1° and 6° to each other. Thus, the angle M between the first or second flange 4, 5 and the web 3 is between 90.5° and 93°. These details refer to the condition of the dry-construction stud 1 before installation.

While the dry-construction stud 1 is shown in FIGS. 1 to 3 without knurling, FIGS. 4*a* and 4*b* illustrate the design of the dry-construction stud 1 with knurling. In this case, the knurling is provided over the entire surface area of the web 3 as well as the first and second flanges 4, 5. The knurling comprises a large number of local plastic deformations of the sheet metal.

Figure 5:
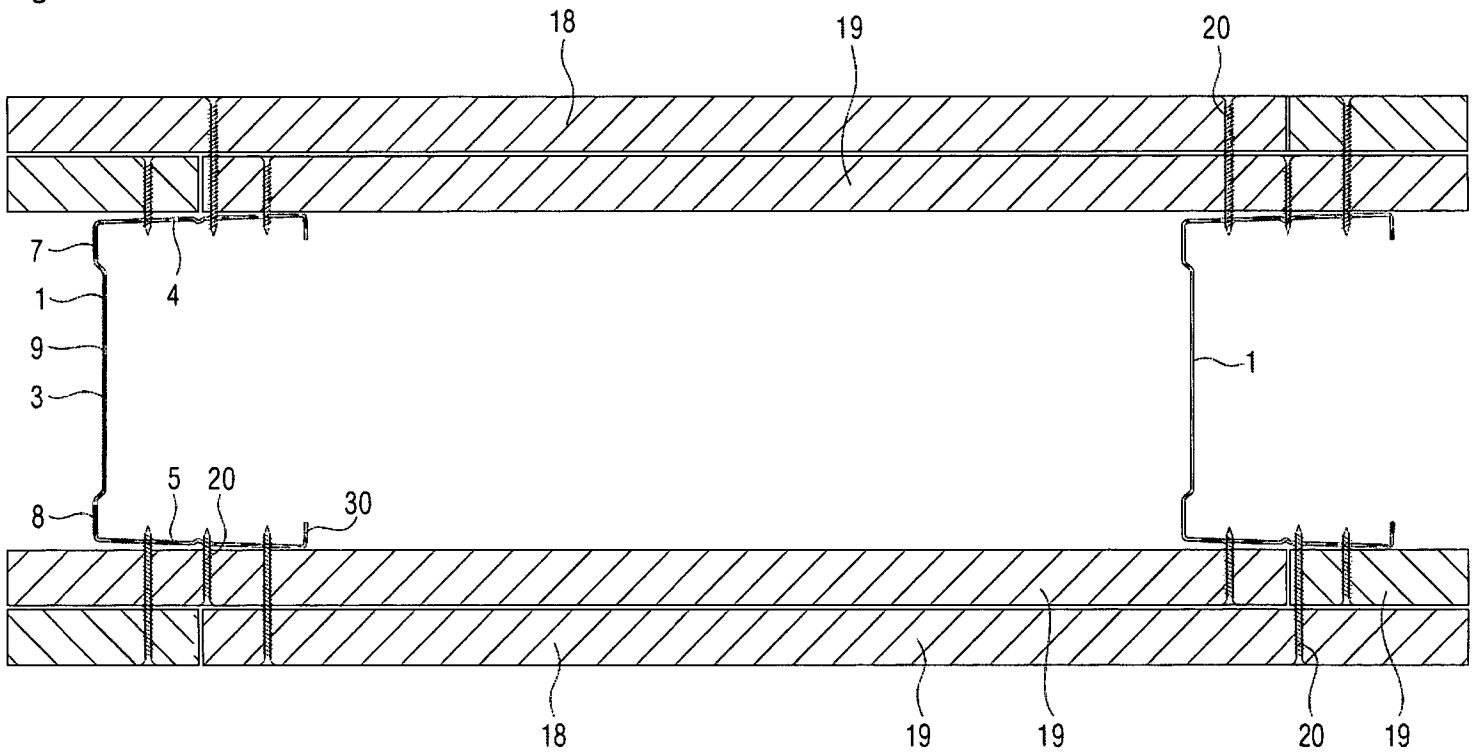
FIG. 5 is a cross-section through the section of a drywall with dry-construction studs from FIG. 1.

FIG. 5 shows the section of a dry-construction wall in a horizontal cross-section. Two of the dry-construction studs 1 are shown, which form vertically arranged elements of the dry-construction wall. In the embodiment shown, a paneling 18 is arranged on both sides of the dry-construction studs 1. The paneling 18 has two layers. The paneling 18 comprises panels 19, which are arranged with fasteners 20 on the first and second flanges 4, 5. In particular, the fasteners 20 can be screws that are screwed through the panels 19 into the first or second flanges 4, 5. However, other fasteners known from dry construction can also be used.

FIG. 5 also shows that the first and second flanges 4, 5 initially are not aligned parallel, but have an angle to each other. When tightening the fasteners, the first and second flanges 4, 5 can be deformed elastically (or elastically and plastically) relative to the web 3 in such a way that they are arranged parallel to one another in the assembled state.

Figure 6:
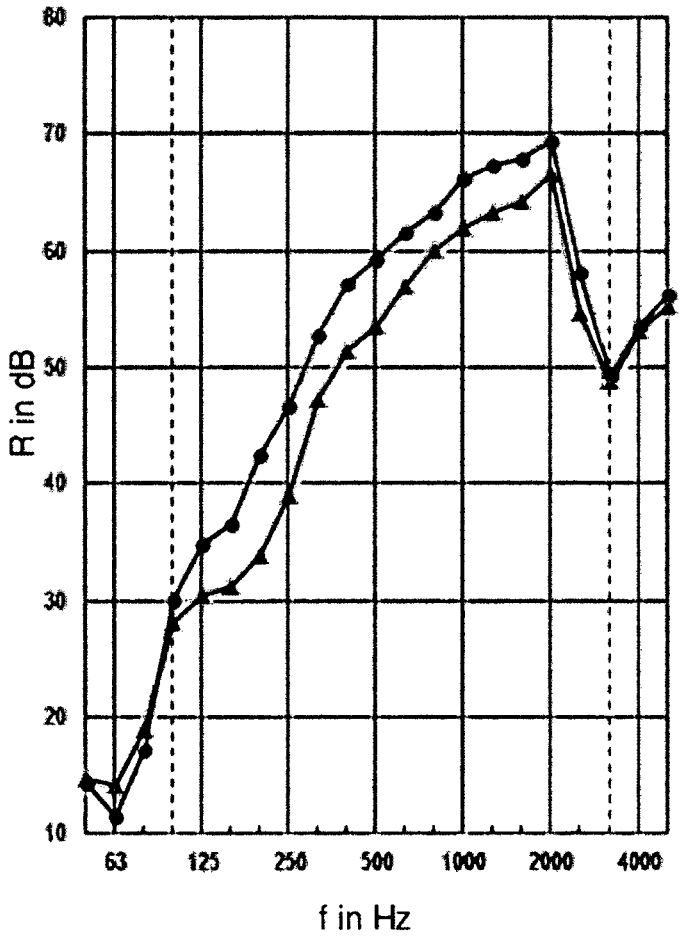
FIG. 6 shows the sound insulation properties of a partition wall constructed with a dry-construction stud according to the invention in comparison with a dry-construction stud with a different design.

FIG. 6 shows measurement results illustrating the improvement in sound insulation properties resulting from a dry-construction stud according to the invention.

The measurement results refer to the following wall construction: The dry-construction wall is designed as a metal stud wall. A knurled dry-construction C-stud having a width K of the web of 75 mm and a width L of the flange of 50 mm is used as the metal studs in each case. The material thickness D is 0.6 mm. The dry-construction studs are arranged with a center distance of 625 mm. The wall is paneled on both sides with two layers of 12.5 mm gypsum boards according to DIN 18180. The cavity is filled with 60 mm mineral wool.

FIG. 6 depicts the measured sound reduction index R as a function of frequency f in Hz.

FIG. 6 shows, on the one hand, the measurement results for a dry-construction wall, which is created with a stud as shown in FIG. 4*a*. The corresponding measurement results are represented by the measurement curve with circles. In comparison, there is shown data for a dry-construction wall with an identical structure, in which a dry-construction stud with a different stud geometry was used. In the case of the different geometry, the flange bead is formed continuously over the entire length of the dry-construction stud, while the web is formed as shown in FIG. 4*a*. The corresponding measurement results are represented by the measurement curve with triangles.

The measurement results, for which the sound reduction index R was determined according to DIN EN ISO 10140-2 (Part 2: Measurement of airborne sound insulation), show a clear improvement in the sound reduction index, in particular above 100 Hz. The sound reduction index R in dB for the geometry according to the invention in the range from 100 Hz to 2,000 Hz is significantly higher than the values achieved with the reference product. The weighted sound reduction index RW is 55.3 dB for the design according to the invention, while the value RW for the reference product is 50.7 dB. This is significant, especially since mathematically, an increase of 3 dB corresponds to a doubling of the sound level. RW indicates the weighted airborne sound reduction index and was determined from the frequency-dependent sound reduction index R according to DIN EN ISO 717-1 (Part 1: Airborne sound insulation). Where reference is made to standards, the information shall refer to the version in force on 1 Dec. 2019 in each case.

What is claimed is:

1. A dry-construction stud comprising:

a web and first and second flanges connected to the web; wherein a plurality of spaced apart flange beads are provided in at least one of the flanges; wherein the flange beads each extend in the longitudinal direction of the stud over a bead length (A), which is less than a total length (B) of the stud, wherein the flange bead length (A) is between 40 mm and 70 mm, wherein a center distance (E) of the flange beads neighboring one another is between 100 mm and 250 mm, wherein the web has a first web section, which forms an edge portion of the web and merges into a bent first flange connecting section that connects the first flange to the web, and in that the web has a second web section, which forms a further edge portion of the web and merges into a bent second flange connecting section, which connects the second web section to the second flange, wherein the web has a web bead arranged between the first and the second web sections, wherein the flange beads reduce sound passing through a dry-construction wall when the stud is assembled in the dry-construction wall, wherein the web bead is arranged centrally in the web, wherein the dry construction stud is a C-stud, wherein the web bead has a web bead height which is between 1 and 5 times the material thickness (D) of the stud, wherein the flange beads have a flange bead height (C) which is between 0.5 and 2 times the material thickness (D) of the stud, wherein the bent first and second flange connecting sections each have a bending radius between 1 mm and 3 mm, wherein the width (K) of the web is between 30 mm and 300 mm and wherein the width (L) of the flanges is between 30 mm and 60 mm.

2. The dry-construction stud according to claim 1, wherein the web bead and the flange beads project in a direction towards the inside of the stud, wherein the flange beads have a flange bead width (F), which is between 2 mm and 4 mm.

3. The dry-construction stud according to claim 2, wherein the first and second flanges are disposed at an opening angle of between 1° and 6° with respect to one another.

4. The dry-construction stud according to claim 3, wherein the web bead has a central region as well as a first transition region to the first web section and a second transition region to the second web section, wherein the first and second transition regions each have an obliquely arranged section, which is arranged at an angle of between 30° and 75° to the central region, wherein the first and second transition regions each have a first radius and a second radius and wherein the obliquely arranged section is arranged between the first and the second radius.

5. The dry-construction stud according to claim 4, wherein the stud has a knurling in the area of the web and in the area of the flanges.

6. A dry-construction wall comprising at least one dry-construction stud according to claim 5 and a paneling attached thereto.

* * * * *